US006162093A

United States Patent [19]

Sudol et al.

[11] Patent Number: 6,162,093

[45] Date of Patent: Dec. 19, 2000

[54] ULTRASOUND TRANSDUCER CONNECTOR ASSEMBLY

[75] Inventors: Wojtek Sudol, Burlington; Francis E. Gurrie, North Andover; Walter Patrick Kelly, Jr., Dracut, all of Mass.

[73] Assignee: Agilent Technologies, Inc., Palo Alto, Calif.

[21] Appl. No.: 09/369,760

[22] Filed: Aug. 6, 1999

[51] Int. Cl.[7] ..... H01R 13/648

[52] U.S. Cl. ..... 439/607; 439/606

[58] Field of Search ..... 439/606, 607, 439/610, 353, 76.1, 736

[56] References Cited

U.S. PATENT DOCUMENTS

| | | | |
|---|---|---|---|
| 4,556,757 | 12/1985 | Oberbach | 439/610 |
| 4,585,292 | 4/1986 | Frantz et al. | 439/610 |
| 5,108,294 | 4/1992 | Marsh et al. | 439/607 |
| 5,201,676 | 4/1993 | Duffield et al. | 439/610 |
| 5,436,803 | 7/1995 | Annis et al. | 439/607 |
| 5,833,495 | 11/1998 | Ito | 439/610 |
| 5,836,774 | 11/1998 | Tan et al. | 439/906 |
| 5,957,727 | 9/1999 | Page, Jr. | 439/607 |

*Primary Examiner*—Paula Bradley
*Assistant Examiner*—Tho D. Ta

[57] ABSTRACT

An ultrasound transducer connector assembly including a low insertion force connector, a leaf spring latch and several alternative housing configurations.

17 Claims, 8 Drawing Sheets

ULTRASOUND TRANSDUCER CONNECTOR ASSEMBLY

FIELD OF THE INVENTION

This invention relates to ultrasound transducer connector assemblies and, more particularly, to an ultrasound transducer connector assembly that includes a low insertion force connector, a leaf spring latch and several alternative housing configurations.

BACKGROUND OF THE INVENTION

FIG. 1. illustrates a typical ultrasound system 10. An ultrasound transducer 12 is coupled to its associated ultrasound console 14 via a cable 16, which is routed into an ultrasound transducer connector assembly 18. Ultrasound transducer connector assembly 18 mates with a corresponding receptacle 20 located on ultrasound console 14. Ultrasound console 14 and ultrasound transducer 12 exchange electrical signals via cable 16.

FIG. 2 offers a more detailed representation of ultrasound transducer connector assembly 18, and shows an electrical circuit 30 and an electrical connector 22 enclosed within a connector housing 24. Electrical connector 22 may have as many as 500 contacts (not shown). To protect the integrity of the electrical signals, a radio frequency interference (RFI) shield 26 is disposed about electrical circuit 30 and coupled to coaxial (coax) shield 28. In the prior art, electrical connector 22 is a zero insertion force (ZIF) connector.

FIG. 3 illustrates a generic ZIF connector 110. It includes a movable connector component 112 with movable electrical contacts 114, designed to mate with a stationary connector component 116 having stationary electrical contacts 118.

For mating, movable connector component 112 is brought towards stationary connector component 116 in the direction indicated by arrow 120. Initially, there is a gap 122 separating movable electrical contact 114 from stationary electrical contact 118, so that the contacts are not subjected to any friction or insertion force. A locking mechanism 124 traverses movable connector component 112 through an aperture 126 and is received in a recess 128 of stationary connector component 116. Locking mechanism 124 is rotated, as indicated by arrow 130, causing movable connector component 112 to close in the direction of arrow 132. This reduces gap 122 allowing movable electrical contact 114 to wipe against stationary electrical contact 118 to make an electrical connection.

ZIF connectors minimize the physical stress exerted upon their electrical contacts, thus avoiding wear and potential damage to the contacts. However, these connectors are mechanically more complex, larger and more expensive than simpler connectors.

Although ZIF locking mechanism 124 offers some latching capability to help secure movable connector component 112 with stationary connector component 116, this latching alone is not sufficient to secure the mating of a typical ultrasound transducer connector assembly to its ultrasound console. Accordingly, ultrasound transducer connectors usually include a latching mechanism in addition to the incidental latching offered by the ZIF connector.

FIG. 4 illustrates a prior art ultrasound transducer connector assembly 150 with a ¼ turn latching mechanism comprising a handle 152 and a shaft 154. Shaft 154 traverses an outer shell 156, and has an end 158 that guides ultrasound transducer connector assembly 150 into a mating connector assembly (not shown). The connection is secured by rotating handle 152 to lock ultrasound transducer connector assembly 150 into its mate. The ¼ turn latching mechanism is mechanically more complex, larger and more expensive than simpler latching mechanisms.

RFI shielding is provided by some form of electrically conductive barrier disposed about the electrical circuit for which protection is desired. The prior art generally provides RFI shielding by enclosing the circuitry within a connector housing comprised of either a metal outer shell or a metal inner shell surrounded by a plastic outer shell. For example, referring again to FIG. 4, the prior art connector assembly 150 includes outer shell 156 made of metal.

When components such as these are manufactured, their physical dimensions must be held to fairly strict tolerances to ensure proper fit during assembly. Additionally, metal is generally more expensive than plastic. Therefore, the cost of an ultrasound transducer connector assembly can be reduced by minimizing the use of components with strict manufacturing tolerances, and by using plastic rather than metal where possible.

Accordingly, there is a need for an ultrasound transducer connector assembly with an electrical connector of minimal mechanical complexity, size and cost, and a latching mechanism of minimal mechanical complexity, size and cost. There is a further need for an ultrasound transducer connector assembly with an RFI shield and connector housing minimizing the use of components requiring strict manufacturing tolerances and minimizing the use of metal components.

SUMMARY OF THE INVENTION

The present invention is directed toward improvement of prior art ultrasound transducer connector assembly 18 (FIGS. 1 and 2).

The new ultrasound transducer connector assembly includes a low insertion force (LIF) connector rather then a ZIF connector as typically used in the prior art. A low insertion force connector requires an insertion force of 20–100 grams/contact to effectuate mating of the connector, and corresponding contacts actively wipe against one another during the act of insertion. The preferred embodiment uses a multi-row, plate-on-beam connector with contact spacing of less than 3 mm. This preferred connector is mechanically less complex, smaller and less expensive than the ZIF connectors used in the prior art.

The new ultrasound transducer connector assembly includes a leaf spring latch rather than the ¼ turn latch as typically used in the prior art. A leaf spring latch is mechanically less complex, smaller and less expensive than the ¼ turn latch.

The new ultrasound transducer connector assembly may employ one of three housing configurations. These housing configurations use combinations of various materials, namely a premolding, an inner shell, an overmolding and an outer shell. These materials are briefly described below.

Premolding, also known as insert molding, is a plastic that is molded around an item. During application, the plastic is in a liquid state. It thereafter solidifies, causing the item to be completely engulfed. When premolding is used for one of the housing configurations for the present invention, the premolding is disposed about the electric circuit within the ultrasound transducer connector assembly.

An inner shell is a solid inner housing that encloses the electric circuit. Depending on the housing configuration, it can be composed of either metal, metalized plastic, or non-metalized plastic. When an inner shell is composed of non-metalized plastic, it is further wrapped in a conductive material.

An overmolding is a plastic outer housing that is molded around an item. The item to be overmolded is placed within a mold cavity. The overmolding plastic is liquefied by subjecting it to heat and increased pressure. It is thereafter injected into the mold cavity and engulfs the item. Overmolding is an inexpensive alternative to an outer shell.

An outer shell is a solid plastic outer housing. When used in the present invention, the outer shell is applied around an inner shell of non-metalized plastic that has been wrapped in a conductive material.

As mentioned earlier, the present invention may employ one of three housing configurations. These housing configurations are briefly described below.

Housing configuration #1 of the present invention uses a premolding, an RFI shield and an overmolding. The premolding is applied over the electric circuit. The RFI shield is composed of metal tape, metal wire mesh or sheetmetal, and is disposed about the premolding. The overmolding is applied around the RFI shield. When the RFI shield is composed of either metal tape or metal wire mesh, the metal inner housing of the prior art is avoided. The overmolding is used in place of the metal outer housing or plastic outer shell of the prior art. Housing configuration #1 is less expensive than the housings used in the ultrasound transducer connector assemblies of the prior art.

Housing configuration #2 of the present invention uses an inner shell and an overmolding. The inner shell encloses the electric circuit. The inner shell is composed of either a metal or a metalized plastic, and thus provides RFI shielding. The overmolding is applied around the inner shell. The overmolding is used in place of the metal outer housing or plastic outer shell of the prior art. Housing configuration #2 is less expensive than the housings used in the ultrasound transducer connector assemblies of the prior art.

Housing configuration #3 of the present invention uses a plastic inner shell, a conductive wrap shield and a plastic outer shell. The plastic inner shell encloses the electric circuit. The plastic inner shell is enclosed in a wrap composed of a conductive material for RFI shielding, which is further enclosed in a plastic outer shell. The plastic inner shell with the conductive wrap is used in place of the metal inner shell of the prior art, and the plastic outer shell is used in place of the metal outer shell of the prior art. Housing configuration #3 is less expensive than the housings used in the ultrasound transducer connector assemblies of the prior art.

Regardless of housing configuration selected, the present invention also includes a cable strain relief for the benefit of the coax cable routed from the transducer.

DETAILED DESCRIPTION OF THE PREFERRED EMBODIMENTS

The new ultrasound transducer connector assembly comprises a low insertion force connector, a leaf spring latch, a cable strain relief and one of three housing configurations.

Figure 1:
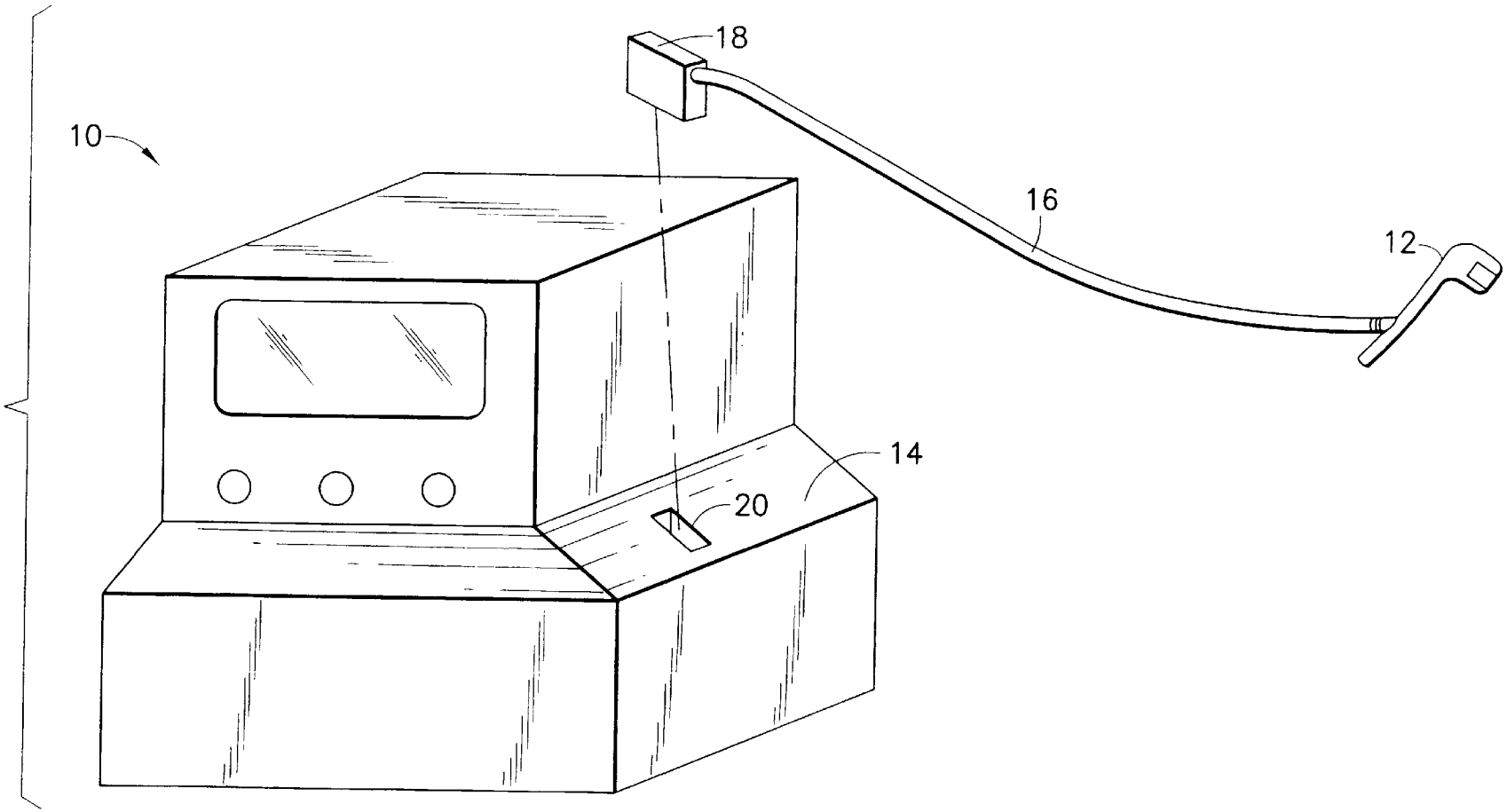
FIG. 1 PRIOR ART
FIG. 1 is a diagram of a typical ultrasound system.
Figure 2:
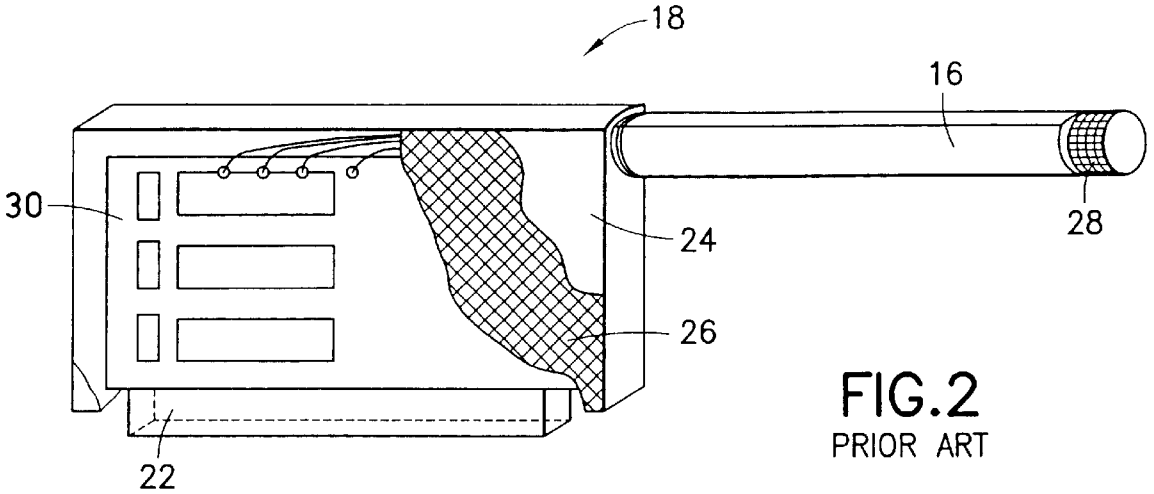
FIG.2 PRIOR ART
FIG. 2. is a front elevational view, with portions broken away, of a typical ultrasound transducer connector assembly.
Figure 5:
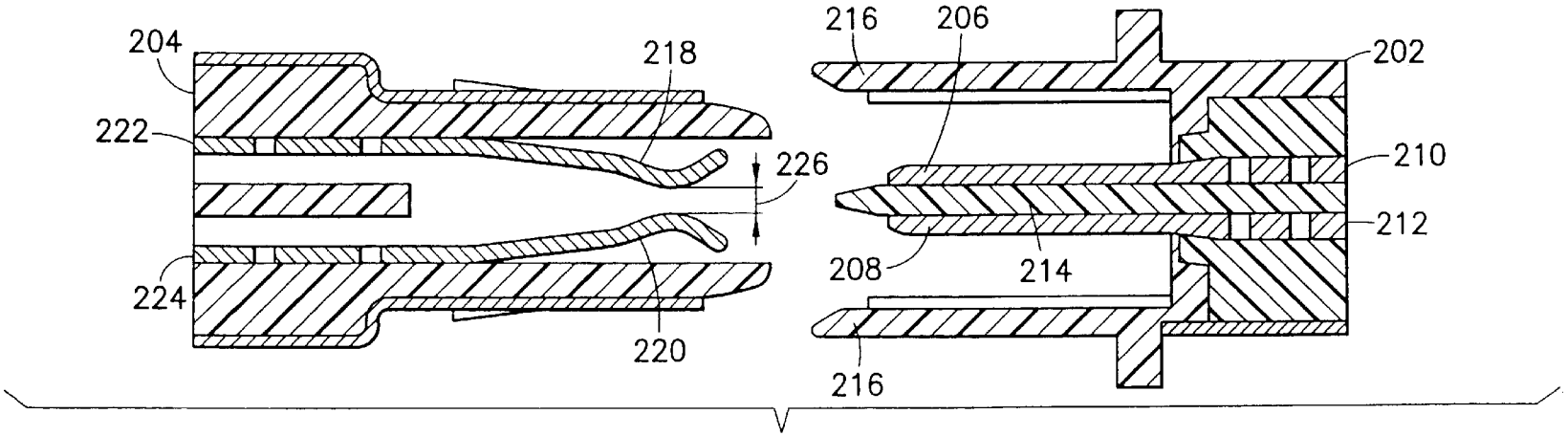
FIG.5 PRIOR ART
FIG. 5 is a cross-sectional view of a plate-on-beam connector.
Figure 3:
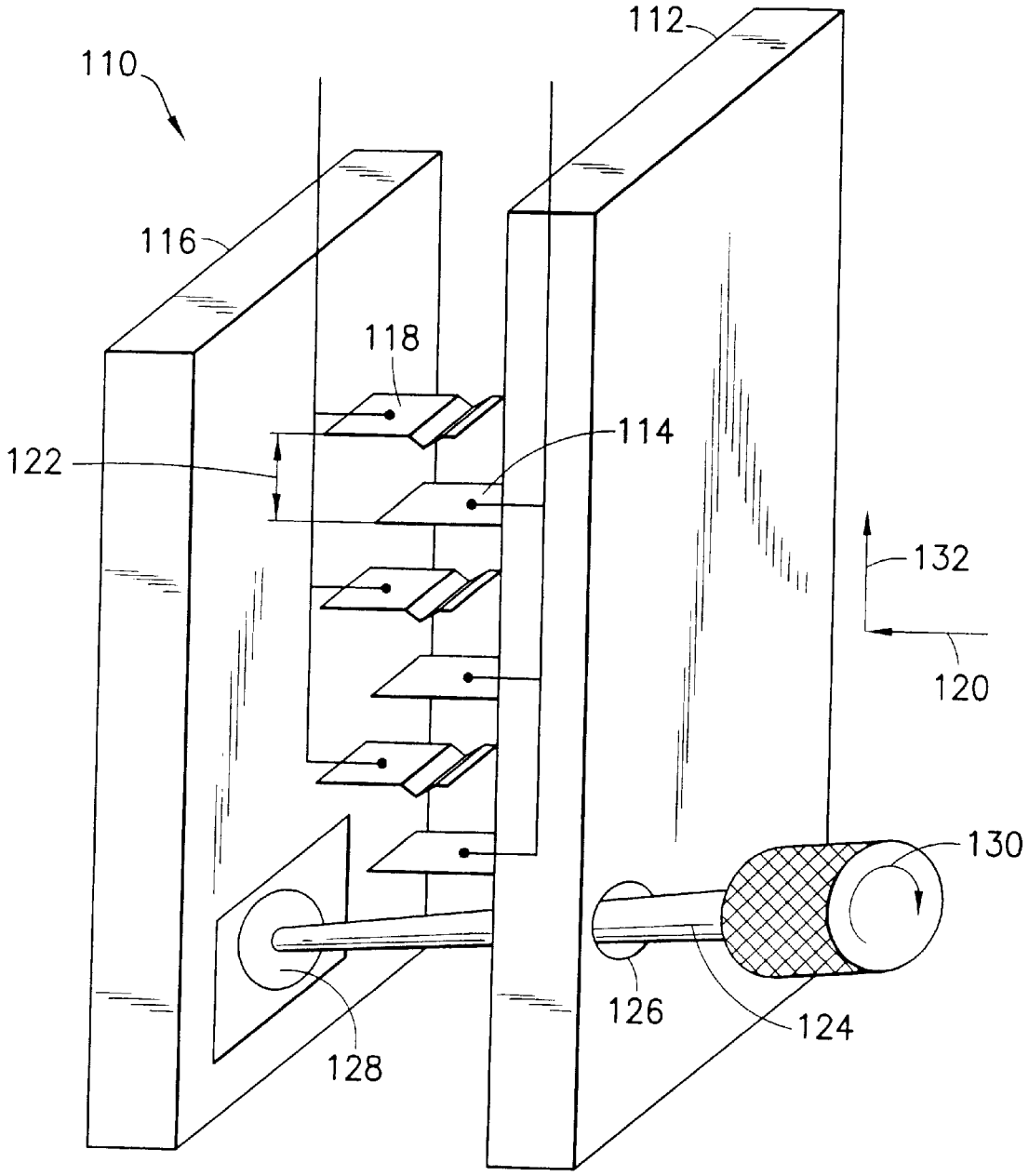
FIG.3 PRIOR ART
FIG. 3 is a diagram of a zero insertion force connector.
Figure 4:
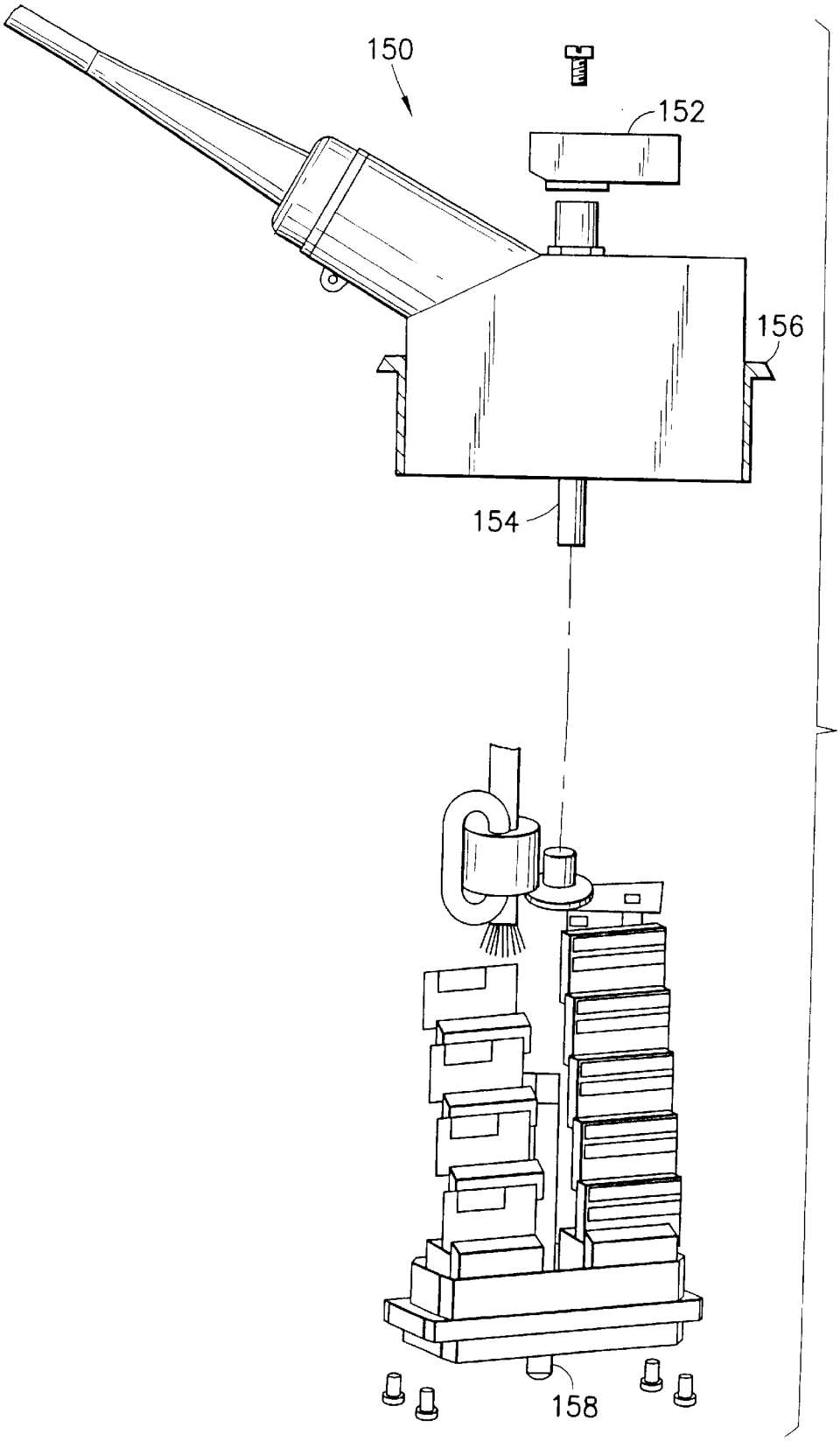
FIG.4 PRIOR ART
FIG. 4 is an exploded view of a prior art ultrasound transducer connector assembly.

FIG. 5. shows a low insertion force connector commonly known as a plate-on-beam connector. Plate-on-beam connector 200 includes a first LIF connector part 202 and a second LIF connector part 204.

First LIF connector part 202 has two electrically conductive surfaces, i.e., a plate A 206 and a plate B 208. Plate A 206 and plate B 208 can be electrically coupled to an electrical circuit (not shown) via a plate A terminal 210 and a plate B terminal 212, respectively. Plate A 206 and plate B 208 are substantially parallel to one another, but separated by a non-conductive appendage 214. First LIF connector part 202 also includes an LIF connector housing 216, which can be electrically conductive to provide some RFI shielding.

Second LIF connector part 204 includes two electrically conductive surfaces, i.e., a beam A 218 and a beam B 220. Beam A 218 and beam B 220 can be electrically coupled to an electrical circuit (not shown) via a beam A terminal 222 and a beam B terminal 224, respectively. Beam A 218 and beam B 220 are each composed of a resilient material and at rest, they are positioned such that beam A 218 and beam B 220 form a gap 226.

During mating, an insertion force is applied to bring first LIF connector part 202 together with second LIF connector part 204, and as a result, appendage 214 is inserted into gap 226. Plate A 206 contacts beam A 218 and plate B 208 contacts beam B 220. Gap 226 is widened and as beam A 218 and beam B 220 are forced away from their positions of rest, they assert a contact pressure on plate A 206 and plate B 208, respectively.

The present invention calls for a multi-row, plate-on-beam connector, having up to 500 contacts with contact spacing of less than 3 mm. An insertion force ranging from 20 to 100 grams/contact is required to effectuate mating. It should be understood that various alternative low insertion force connectors concepts can be used without departing from the invention.

Figure 6A:
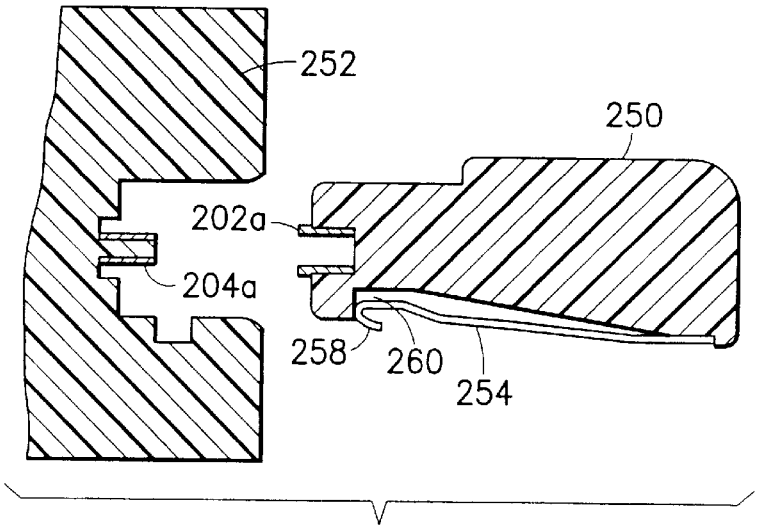
FIGS. 6*a*–6*c* are several side profile views of a new ultrasound transducer connector assembly as it is being inserted into a mating receptacle.
Figure 6B:
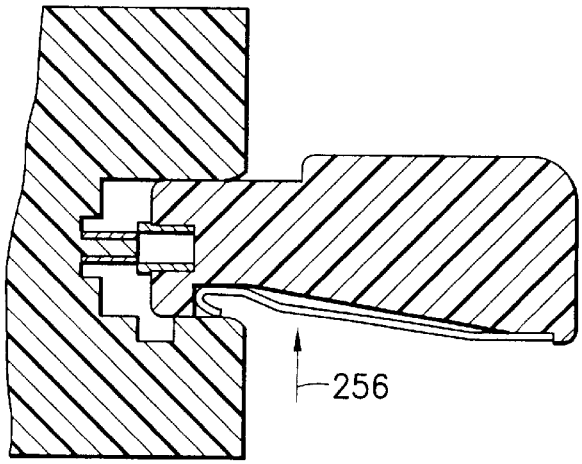
Figure 6C:
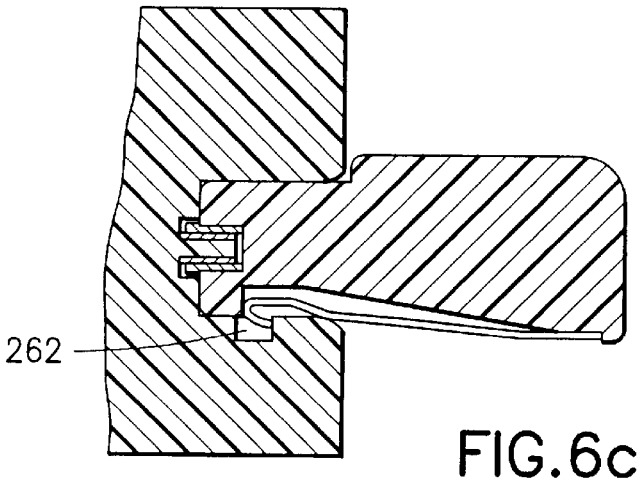
Figure 7C:
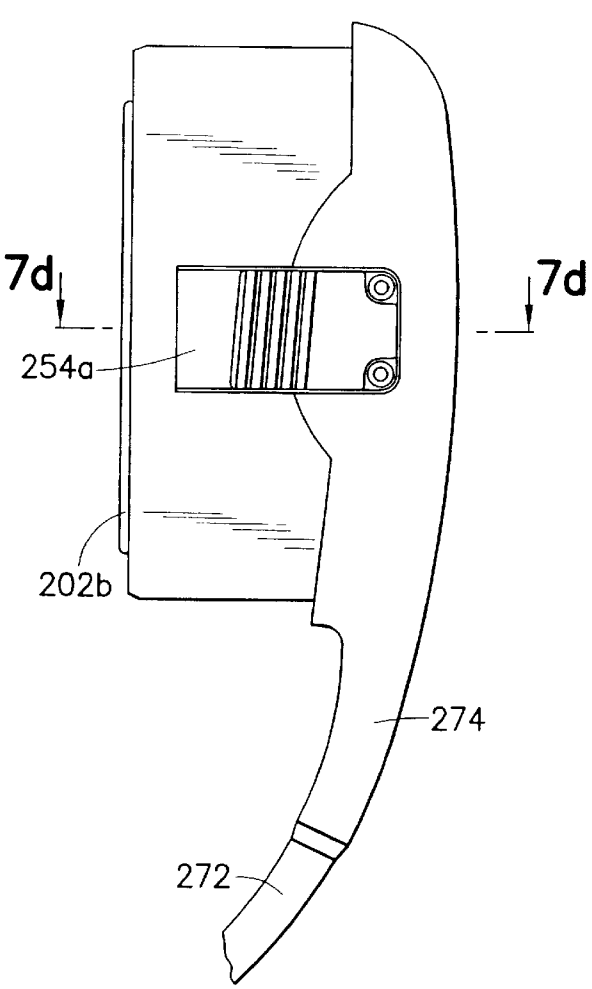
FIGS. 7*a*–7*d* are several views of a new ultrasound transducer connector assembly including a first LIF connector part of a 120-contact, multi-row plate-on-beam connector, and a leaf spring latch.
Figure 7B:
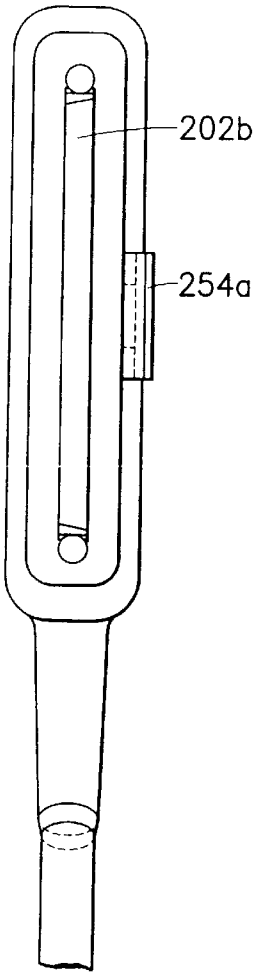
Figure 7A:
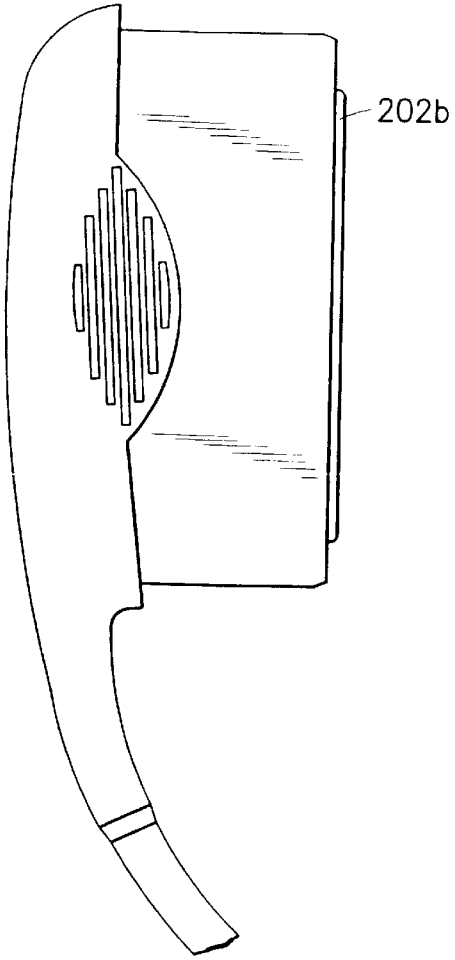

FIGS. 6*a*–6*c* show a side profile view of a new ultrasound transducer connector assembly 250 as it is being inserted into a mating receptacle 252. A plate-on-beam connector having a first LIF connector part 202*a* will mate with a corresponding second LIF connector part 204*a*. Although new ultrasound transducer connector assembly 250 is shown here to include first LIF connector part 202*a*, the design is not limited to this configuration, and new ultrasound transducer connector assembly 250 may instead include second connector LIF connector part 204*a*.

Note the inclusion of leaf spring latch 254. A latch is included to prevent ultrasound transducer connector assembly 250 from accidentally disconnecting from mating receptacle 252. FIGS. 6*a* and 6*b* show that during insertion of ultrasound transducer connector assembly 250 into mating receptacle 252, an applied force 256 causes a latching head 258 to retreat into a recess 260. In FIG. 6*c*, when ultrasound transducer connector assembly 250 is fully inserted, latching head 258 locks into recess 262. Although other latching means can be used, leaf spring latch 254 is preferred because it requires minimal space and is relatively inexpensive as compared to other latching devices.

FIGS. 7*a*–7*d* illustrate an example of a new ultrasound transducer connector assembly including a first LIF connector part 202*b* of a 120-contact, multi-row plate-on-beam connector, and a leaf spring latch 254*a* as previously described.

First LIF connector part 202*b* is coupled to an electrical circuit 270, and a cable 272 couples electrical signals from electrical circuit 270 to an ultrasound transducer (not shown). Cable strain relief 274 is included to reduce mechanical stress on cable 272 near the area where it is coupled to electrical circuit 270. Electrical circuit 270 is typically a printed circuit board populated with electrical components, but the present invention does not contemplate limiting electrical circuit 270 to any specific physical configuration.

The regions designated by reference numbers 280, 282 and 284 collectively represent a connector housing. The new ultrasound transducer connector assembly can employ one of three housing configurations. These housing configurations are described below.

Figure 8:
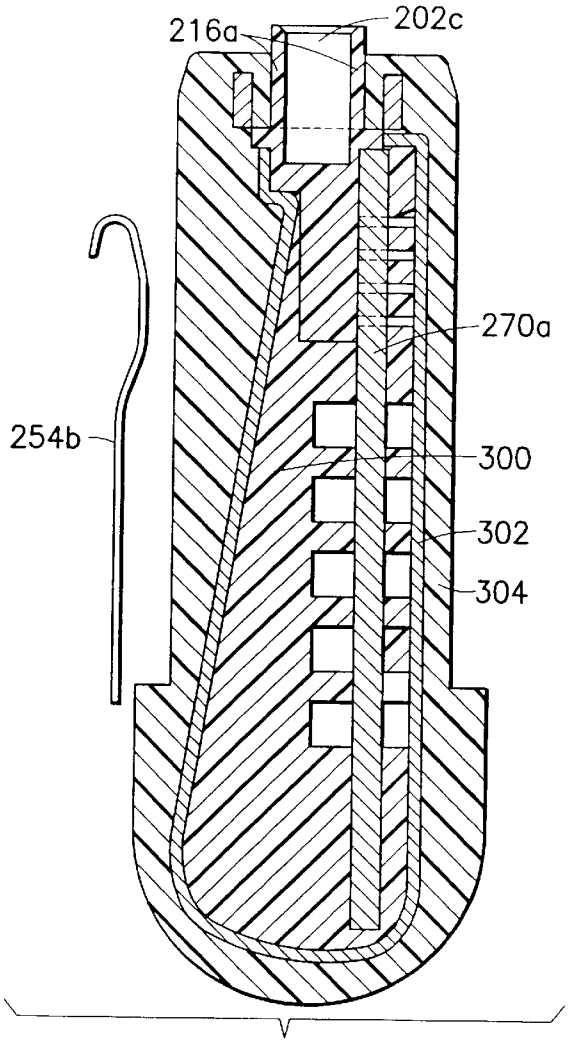
FIG. 8 is a cross-sectional view of a new ultrasound transducer connector assembly employing housing configuration #1.
Figure 7D:
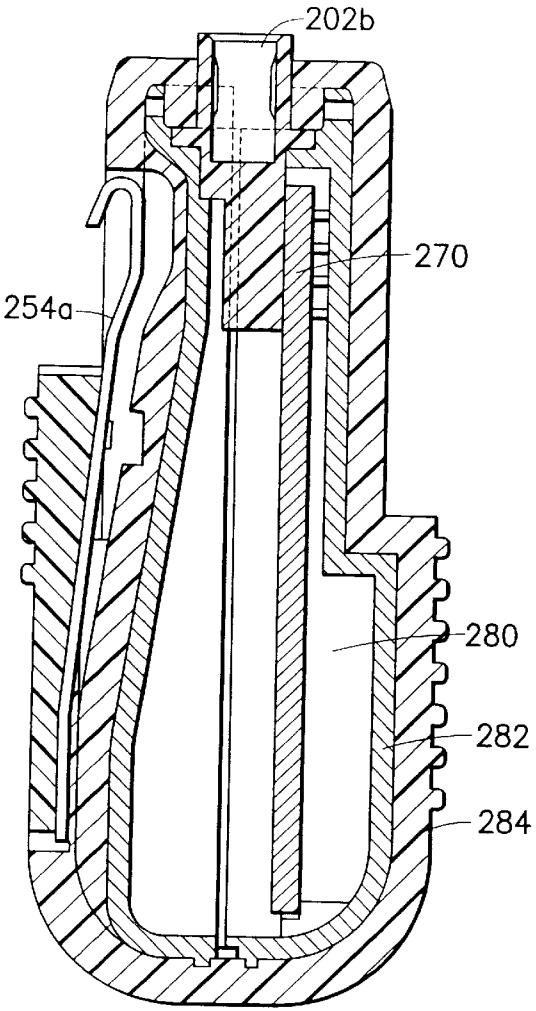

FIG. 8 is a cross-sectional view of a new ultrasound transducer connector assembly employing housing configuration #1, which uses a premolding 300, an RFI shield 302 and an overmolding 304. As previously described, the assembly includes a first LIF connector part 202*c* with an electrically conductive LIF connector housing 216*a*, a leaf spring latch 254*b* and an electrical circuit 270*a*.

Premolding 300 is disposed about electrical circuit 270*a*. Premolding 300 is composed of a non-conductive plastic such as polyethylene, thermoplastic, thermosetting or epoxy. Polyethylene is the preferred material because it is the easiest to use and is the least expensive. It may be applied with a thickness ranging from 0.030 to 0.300 inches, preferably in the range of 0.040 to 0.080 inches.

RFI shield 302 encloses premolding 300, and is coupled to LIF connector housing 216*a*. RFI shield 302 can be composed of metal tape, metal wire mesh or sheetmetal.

Overmolding 304 is applied over RFI shield 302 and optionally, a portion of LIF connector housing 216*a*. Overmolding 304 is composed of a plastic, preferably polyvinyl chloride (PVC). It may be applied with a thickness ranging from 0.030 to 0.300 inches, preferably from 0.040 to 0.100 inches.

The successful yield of the overmolding process is about 95%. That is, about 5% of the overmolded connector assemblies are rejected due to overmolding defects.

Overmolding defects cannot be repaired. Additionally, the premolding prevents access to, and repair of, the electric circuit. Accordingly, housing configuration #1 is most economically practical when the combined cost of the electric circuitry and the cable are not significantly greater than the savings afforded by using the premolding and the overmolding.

Figure 9:
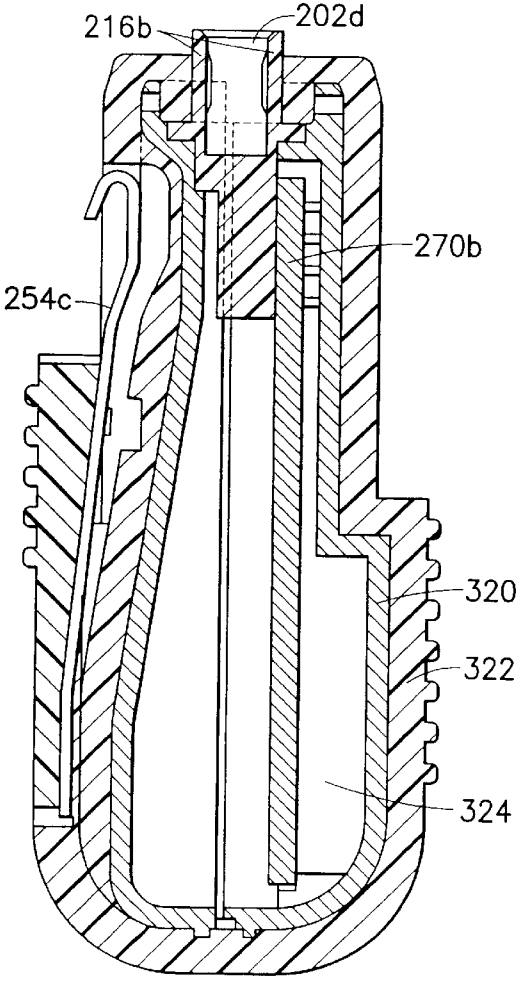
FIG. 9 is a cross-sectional view of a new ultrasound transducer connector assembly employing housing configuration #2.

FIG. 9 is a cross-sectional view of a new ultrasound transducer connector assembly employing housing configuration #2, which uses an inner shell 320 and an overmolding 322. As previously described, the assembly includes a first LIF connector part 202d with an electrically conductive LIF connector housing 216*b*, a leaf spring latch 254*c* and an electrical circuit 270*b*.

Inner shell 320 encloses electrical circuit 270*b*, and is coupled to LIF connector housing 216*b*. Inner shell 320 is composed of either a conductive metal or a metalized plastic. Metalized plastic is a plastic, such as thermoplastic or thermosetting, coated with a metal film. The metal film is electrically conductive and can be applied with a thickness ranging from 0.00001 to 0.010 inches, preferably from 0.0001 to 0.001 inches. As inner shell 320 is conductive, it also serves as an RFI shield.

Overmolding 322 is applied over inner shell 320, and optionally, a portion of LIF connector housing 216*b*. Overmolding 322 is composed of a plastic, preferably polyvinyl chloride (PVC). It may be applied with a thickness ranging from 0.030 to 0.300 inches, preferably from 0.040 to 0.100 inches.

If an overmolding defect occurs, overmolding 304 and inner shell 302 can be removed, and electrical circuit 270*a* can be salvaged and reworked. However, during the overmolding process, if the perimeter of inner shell 304 has any gap, the overmolding plastic may leak into the interior region 324 and damage electrical circuit 270*a*.

Figure 10:
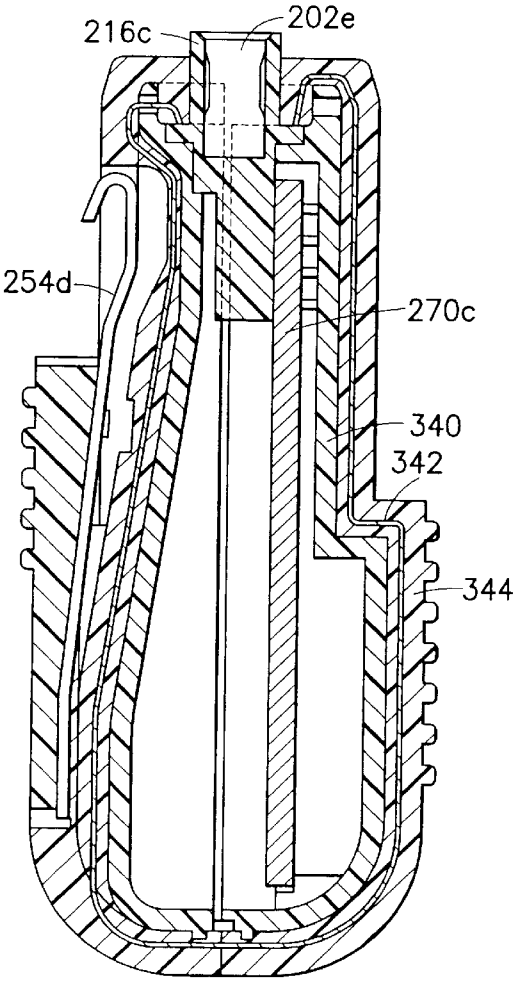
FIG. 10 is a cross-sectional view of a new ultrasound transducer connector assembly employing housing configuration #3.

FIG. 10 is a cross-sectional view of a new ultrasound transducer connector assembly employing housing configuration #3, which uses an inner shell 340, a conductive wrap 342, and an outer shell 344. As previously described, the assembly includes a first LIF connector part 202*e* with an electrically conductive LIF connector housing 216*c*, a leaf spring latch 254*d* and an electrical circuit 270*c*.

Inner shell 340 encloses electrical circuit 270*c*. Inner shell 340 is non-conductive and composed of a plastic such as thermoplastic or thermosetting.

Conductive wrap 342 encloses inner shell 340, and is coupled to LIF connector housing 216*c*. Conductive wrap 342 is composed of a conductive material such as copper foil or wire mesh, and it provides RFI shielding.

Outer shell 344 encloses conductive wrap 342, and optionally, a portion of LIF connector housing 216*c*. Outer shell 344 is preferably composed of plastic.

If electrical circuit 270*c* needs to be accessed or reworked, then outer shell 344, conductive wrap 342 and inner shell 340 can be removed.

It should be understood that various alternatives and modifications can be devised by those skilled in the art without departing from the invention. For example, the ultrasound transducer connector housings could be composed of plastics or conductive wraps other than the types mentioned above. Accordingly, the present invention is intended to embrace all such alternatives, modifications and variances that fall within the scope of the appended claims.

What is claimed is:

1. An ultrasound transducer connector assembly comprising:

an electric circuit assembly;

an electrical connector for mating with a corresponding connector external to said ultrasound transducer connector assembly, coupled to said electric circuit assembly, and having a plurality of electrical contacts and an electrical connector housing disposed about said plurality of electrical contacts, wherein said electrical connector and said corresponding connector cooperate to function as a low insertion force connector, said low insertion force connector comprising means for deflecting a conductive beam of one of said connectors, upon said mating, to contact an abutment of an exposed contact of the other of said connectors and thereby increase a wiping force between said conductive beam and said opposed contact;

a premolding disposed about said electric circuit assembly;

RFI shielding means disposed about said premolding, and coupled to said electrical connector housing; and an overmolding disposed about said RFI shielding means.

2. The ultrasound transducer connector assembly of claim 1, wherein said premolding is composed of a plastic selected from the group consisting of polyethylene, thermoplastic, thermosetting and epoxy.

3. The ultrasound transducer connector assembly of claim 1, wherein said RFI shielding means is composed of a material selected from the group consisting of metal tape, metal wire mesh, and sheetmetal.

4. The ultrasound transducer connector assembly of claim 1, wherein said overmolding is composed of a plastic.

5. The ultrasound transducer connector assembly of claim 1, further comprising a latching means for mechanically securing said electrical connector to said corresponding connector.

6. The ultrasound transducer connector assembly of claim 5, wherein said latching means is a leaf spring latch.

7. An ultrasound transducer connector assembly comprising:

an electric circuit assembly that interface with an ultrasound transducer;

an electrical connector for mating with a corresponding connector external to said ultrasound transducer connector assembly, coupled to said electric circuit assembly, and having a plurality of electrical contacts and an electrical connector housing disposed about said plurality of electrical contacts, wherein said electrical connector and said corresponding connector cooperate to function as a low insertion force connector, said low insertion force connector comprising means for deflecting a conductive beam of one of said connectors, upon said mating, to contact an abutment of an exposed contact of the other of said connectors and thereby increase a wiping force between said conductive beam and said opposed contact;

an electrically conductive shell disposed about said electric circuit assembly, and coupled to said electrical connector housing;

an overmolding disposed about said shell; and a latching means for mechanically securing said electrical connector to said corresponding connector.

8. The ultrasound transducer connector assembly of claim 7, wherein said shell is composed of a metal.

9. The ultrasound transducer connector assembly of claim 7, wherein said shell is composed of a metalized plastic comprising a plastic selected from the group consisting of thermoplastic and thermosetting, and a metal film disposed about said plastic.

10. The ultrasound transducer connector assembly of claim 7, wherein said overmolding is composed of a plastic.

11. The ultrasound transducer connector assembly of claim 7, wherein said latching means is a leaf spring latch.

12. An ultrasound transducer connector assembly comprising:

an electric circuit assembly;

an electrical connector for mating with a corresponding connector external to said ultrasound transducer connector assembly, coupled to said electric circuit assembly, and having a plurality of electrical contacts and an electrical connector housing disposed about said plurality of electrical contacts, wherein said electrical connector and said corresponding connector cooperate to function as a low insertion force connector, said low insertion force connector comprising means for deflecting a conductive beam of one of said connectors, upon a mating action, to contact an abutment of an exposed contact of the other of said connectors and thereby increase a wiping force between said conductive beam and said opposed contact;

an inner shell disposed about said electric circuit assembly;

a conductive wrap disposed about said inner shell, and coupled to said electrical connector housing;

an outer shell disposed about said conductive wrap.

13. The ultrasound transducer connector assembly of claim 12, wherein said inner shell is composed of a plastic selected from the group consisting of thermoplastic and thermosetting.

14. The ultrasound transducer connector assembly of claim 12, wherein said conductive wrap is selected from the group consisting of copper foil and wire mesh.

15. The ultrasound transducer connector assembly of claim 12, wherein said outer shell is composed of a plastic.

16. The ultrasound transducer connector assembly of claim 12, further comprising a latching means for mechanically securing said electrical connector to said corresponding connector.

17. The ultrasound transducer connector assembly of claim 16, wherein said latching means is a leaf spring latch.

* * * * *